US011814924B2

(12) United States Patent
Tran et al.

(10) Patent No.: US 11,814,924 B2
(45) Date of Patent: Nov. 14, 2023

(54) APPARATUS AND METHOD FOR PREPARING A DOWNHOLE TOOL COMPONENT

(71) Applicant: CNPC USA Corporation, Houston, TX (US)

(72) Inventors: Anthony Tran, Kemah, TX (US); Jeff Maynard, Angleton, TX (US); Jianpeng Yue, Sugar Land, TX (US)

(73) Assignee: CNPC USA Corporation, Houston, TX (US)

( * ) Notice: Subject to any disclaimer, the term of this patent is extended or adjusted under 35 U.S.C. 154(b) by 338 days.

(21) Appl. No.: 17/347,972

(22) Filed: Jun. 15, 2021

(65) Prior Publication Data

US 2022/0397015 A1 Dec. 15, 2022

(51) Int. Cl.
*E21B 33/129* (2006.01)
*B05C 13/02* (2006.01)

(52) U.S. Cl.
CPC ..... *E21B 33/1291* (2013.01); *B05C 13/02* (2013.01)

(58) Field of Classification Search
CPC ..... B05C 7/00; B05C 13/02; B65D 85/02; B65D 85/54; E21B 33/1291
See application file for complete search history.

(56) References Cited

U.S. PATENT DOCUMENTS 2,687,775 A 8/1954 Baker
2,767,417 A * 10/1956 Amen ..... B05B 11/029 15/210.1
2,810,145 A * 10/1957 Forrow ..... E21B 17/006 401/9
2,828,857 A * 4/1958 Mackay ..... B65D 85/54 29/455.1
2,999,544 A 9/1961 Conrad et al.
3,398,795 A 8/1968 Elliston
3,897,159 A * 7/1975 Ball ..... B23Q 13/00 401/9
4,469,172 A 9/1984 Clark
4,657,084 A 4/1987 Evans
4,790,430 A * 12/1988 Thomas ..... B65D 85/02 206/452
5,127,520 A * 7/1992 Thomas ..... F16D 65/00 220/4.22
6,378,399 B1 4/2002 Bangert
7,600,450 B2 10/2009 Montgomery et al.
8,579,024 B2 11/2013 Mailand et al.
(Continued)

*Primary Examiner* — David P Angwin
*Assistant Examiner* — Bradley S Oliver
(74) *Attorney, Agent, or Firm* — Craft Chu PLLC; Andrew W. Chu

(57) ABSTRACT

The apparatus prepares a downhole tool component, particularly a slip for a plug that seals zones in a wellbore. The apparatus includes a casing holder, a cone insert, and a cap. There is a bottom center connector to hold the cone insert within the casing holder. There are a plurality of spacing bolts, and a top center connector to hold the slip within the space between the cap, the cone insert, and the casing holder. The top center connector can adjust distance between the slip and the cone insert so that the coating on the ramp surface of the slip has a uniform thickness. The invention includes the method of using the apparatus to prepare the slip with coating of uniform thickness to removably engage another component of the apparatus.

20 Claims, 5 Drawing Sheets

(56) References Cited

U.S. PATENT DOCUMENTS

| | | | | |
|---|---|---|---|---|
| 9,181,763 | B2 | 11/2015 | McIntosh et al. | |
| 9,835,003 | B2 | 12/2017 | Harris et al. | |
| 9,970,256 | B2 | 5/2018 | Davies et al. | |
| 10,016,918 | B2 | 7/2018 | Rochen et al. | |
| 10,119,360 | B2 | 11/2018 | Kellner et al. | |
| 10,280,698 | B2 | 5/2019 | Potts et al. | |
| 11,596,970 | B2 * | 3/2023 | Pressey | B65D 47/043 |
| 2016/0123105 | A1 * | 5/2016 | Reinhardt | E21B 33/129 166/387 |
| 2016/0290093 | A1 * | 10/2016 | Doane | E21B 33/128 |
| 2016/0376869 | A1 | 12/2016 | Rochen et al. | |
| 2020/0347694 | A1 | 11/2020 | Power et al. | |

* cited by examiner

APPARATUS AND METHOD FOR PREPARING A DOWNHOLE TOOL COMPONENT

CROSS-REFERENCE TO RELATED APPLICATIONS

See Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The present invention relates to an apparatus and method for coating components of downhole tools. More particularly, the present invention relates to applying a grit coating between slip devices and a cone insert in a plug. Even more particularly, the present invention relates to an apparatus and method for applying a uniform coating on curved conical surfaces.

2. Description of Related Art Including Information Disclosed Under 37 CFR 1.97 and 37 CFR 1.98

Coatings applied to a substrate are known to enhance the physical properties of the substrate. One of the simplest coatings is paint, which changes the color of the substrate. A substrate with the required hardness and strength can also be modified with a coating to change friction of the substrate surface, such as a coating of grease to make a substrate slick. There are more complex considerations for grit coatings that increase friction of the substrate. Grit coatings are comprised of an abrasive material and an adhesive matrix. The abrasive materials can be abrasive grains and minerals, like diamond dust, sand, or calcite. The size and dimensions of the abrasive grains and minerals affect the application and uniformity of the grit coating. Various patents and publication disclose grit coatings on machine components, such as U.S. Pat. No. 7,600,450, issued on 13 Oct. 2009 to Montgomery et al. and U.S. Pat. No. 7,036,397, issued on 2 May 2006 to Bangert.

There are also known grit coatings in the oil and gas industry. Various patents and publications disclose grit coatings on downhole tool components. The grit coating is typically used to increase friction of components against the borehole wall of a wellbore. See U.S. patent Ser. No. 10/000,991, issued on 19 Jun. 2018 to Harris et al., U.S. Pat. No. 8,579,024, issued on 12 Nov. 2013 to Mailand et al., U.S. Pat. No. 4,901,794, issued on 20 Feb. 1990 to Baugh et al., and US Publication No. 2016/0290093, published on 6 Oct. 2016 for Doane et al. There are some disclosures of grit coatings on inner surfaces between components themselves, such as U.S. Pat. No. 9,976,381, issued on 22 May 2018 to Martin et al., and US Publication No. 2019/0032445, published on 31 Jan. 2019 for Dempsey.

There are further complications for the grit coatings in downhole tools. The curved and conical surfaces of downhole tool components are difficult for applying even layers of any coatings. In particular for slip devices, applying by spray or drip results in uneven thickness of coatings. Gravity pools or thins on the surface of the slip device as substrate, according to the orientation of the slip device. Any even application of a coating must account for the drip and rotation of the slip device to account for the pooling and thinning. The amount of time to dry and set the coating, and the viscosity of the coating before drying and setting are even further complications for grit coatings on slip devices.

In addition to the size and dimensions of the abrasive minerals affecting uniformity of the grit coating, there are particularly tight tolerances for the thickness of a coating between components of the tool itself. For example, a grit coating can be on the inner surface of a slip device against a cone assembly in a plug. Between components, there is a higher premium for uniformity that can and should be controlled. An uneven or non-uniform thickness of one slip device can unbalance the cone assembly that skews the entire plug. Unlike the outer surface of the slip device that individually engages the borehole wall, each inner surface engages the cone assembly collectively with other slip devices. There is repeated and predictable contact between components in a downhole tool. Grit coatings on outer surfaces of the slip devices engage surfaces separate from the actual tool, like tubulars or the borehole wall. The uniformity is less critical for those grit coatings interacting with these environmental features, which are unpredictable and variable.

It is an object of the present invention to provide an apparatus and method for applying a coating.

It is another object of the present invention to provide an apparatus and method for applying a coating to a curved surface of a downhole tool component.

It is still another object of the present invention to provide an apparatus and method for applying a coating to an inner ramp surface of a slip device.

It is an object of the present invention to provide an apparatus and method for preparing a downhole tool component.

It is another object of the present invention to provide an apparatus and method for preparing a downhole tool component with uniform coating on a curved surface.

It is another object of the present invention to provide an apparatus and method for preparing a downhole tool with a uniform coating between components of the downhole tool.

It is an object of the present invention to provide a reusable apparatus for applying a coating on slip device.

It is an object of the present invention to provide an apparatus and method for correcting the application of a coating on slip device.

These and other objectives and advantages of the present invention will become apparent from a reading of the attached specification, drawings and claims.

BRIEF SUMMARY OF THE INVENTION

Embodiments of the present invention include an apparatus for preparing a downhole tool component, namely, a slip with a ramp surface to engage another downhole tool component. The apparatus includes a casing holder, a cone insert, and a cap. The casing holder is comprised a cylindrical casing body and an end portion with a center casing hole. The cone insert is frustoconical with a top cone end surface, a bottom cone end surface, and a curved side wall surface between the top cone end surface and the bottom cone end surface. There is a center top cone end cavity on the top cone end surface and a center bottom cone end cavity on the bottom cone end surface. The cone insert orientation is shown with the smaller end facing upward to define a space for setting the slip between the cone insert and cylindrical casing body. A bottom center connector removably engages the center bottom cone end cavity through the center casing hole. The cone insert is locked within the cylindrical casing body. The cap being comprised of a disk with a center cap hole and a plurality of spacing holes and a rim. The rim can have a shoulder to engage a complementary slip edge on each slip. The rim and the disk can be made integral.

The apparatus also includes a plurality of spacing bolts and a top center connector to hold the slip within the space between the cap, the cone insert, and the casing holder. Each spacing bolt is removably inserted through a corresponding spacing hole. The rim and adjacent spacing bolts hold the position of the slip mounted into the apparatus. These structures isolate movement of the slip to the cone insert and the ramp surface of the slip so that the coating on the ramp surface can have a uniform thickness.

Embodiments of the present invention also include the top center connector being in removable threaded engagement with the center top cone end activity through the center cap hole. Rotating the top center connector actually sets the uniform thickness of the coating. Actuating the top center connector moves the cap closer to the end portion. The slip is held at the slip edge by a locking shoulder of the cap so that the movement of the slip toward the cone insert is uniform and controlled, while being anchored at the slip edge and guided by the spacing bolts.

In alternative embodiments, the casing holder can be transparent, as well as the cone insert. In these embodiments, the coating can be visually inspected for irregularities. The top center connector can be tightened to address the irregularity, or the apparatus can be partially disassembled to remove the slip with the irregularity.

Embodiments of the present invention further include a method for preparing a downhole tool component. The method prepares a component with a complementary conical curved surface, namely a slip. The method comprises the steps of removably engaging a bottom center connector to a casing holder and a cone insert. The cone insert is locked in position within the casing holder.

The method includes the step of removably engaging a plurality of spacing bolts to a cap. Each spacing bolt is removably inserted through a corresponding spacing hole and is extended from the cap. The method also includes applying a coating to a slip with a ramp surface. The coating is bonded to the ramp surface. The coating now needs to have uniform thickness to be readied as a useable downhole tool component.

The embodiment of the method includes the slip being removably inserted between the cone insert and the cylindrical casing body and between adjacent spacing bolts and the cap being set over the slip and the cone insert. Next, the method includes the steps of removably engaging the top center connector to the center cap hole and the center top cone end cavity, and adjusting distance between the cone insert and the slip by the top center connector so as to control thickness of the coating on the ramp surface.

The step of adjusting distance can include rotating the top center connector. There is tolerance to remove pooling and thinning of the coating from the ramp surface of the slip. Actuating the top center connector moves the cap closer to the end portion and the ramp surface closer to the curved side wall surface of the cone insert.

In an alternative embodiment of at least the casing holder being transparent, the method of the present invention includes detecting an irregularity, such as a blemish, gap, or puddle in the coating. The step of adjusting distance can be used to remove irregularities. Alternative, the cap is removed from the cone insert so that the slip with the irregularity is removed and replaced with another slip.

In another alternative embodiment, the method of the present invention includes multiple slips being prepared in a single apparatus. Before the step of setting the cap over the slip and the cone insert and before the coating is set, an entire set of slips can be prepared with coatings to be set as uniform coatings. The method includes the step of assembly the coating on the slip against another component of the downhole tool.

DETAILED DESCRIPTION OF THE INVENTION

Figure 1:
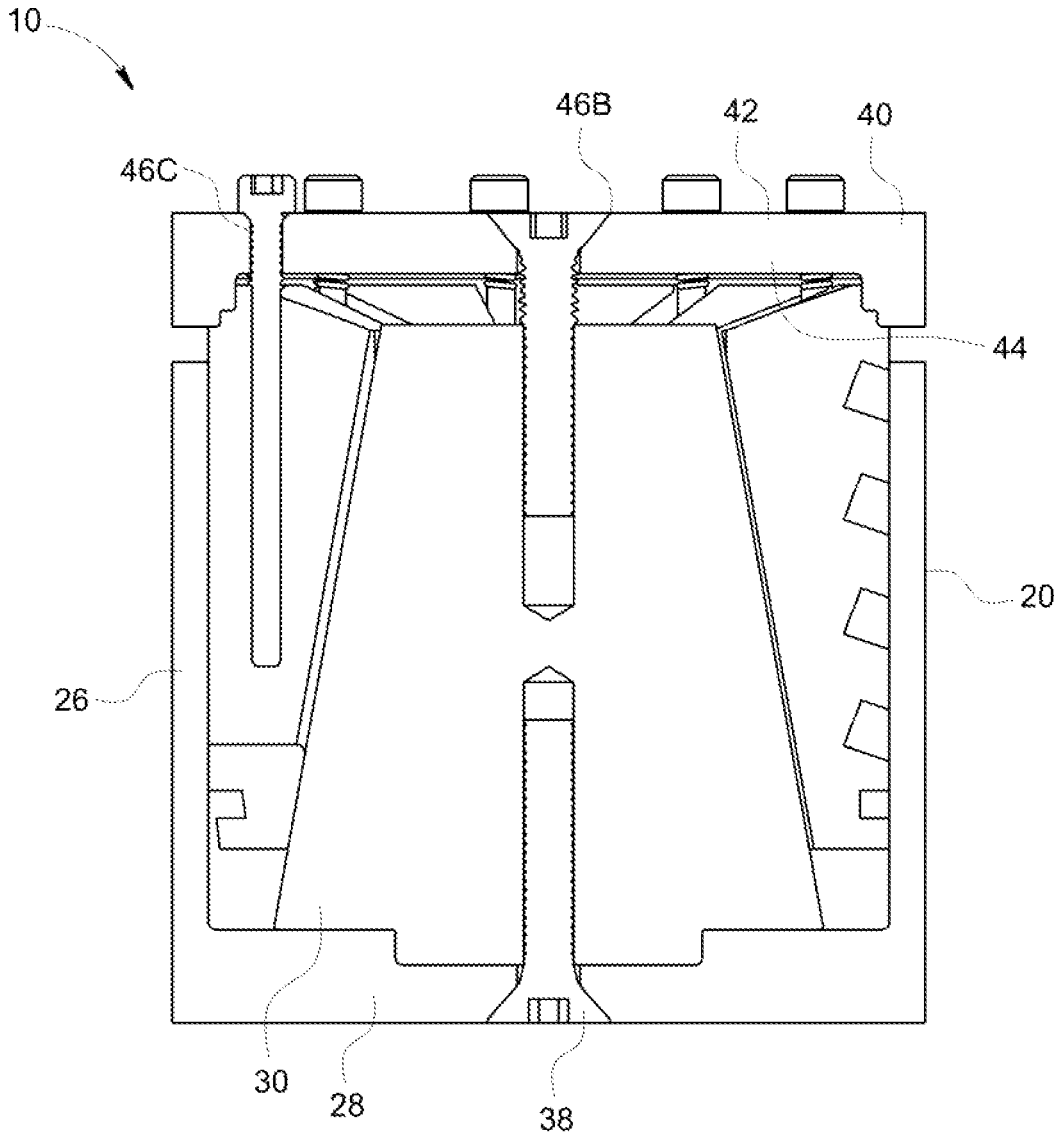
FIG. 1 is a sectional view of an embodiment of the present invention for an apparatus for preparing a downhole tool component, namely, a slip device.

Referring to FIGS. 1-5, the present invention is an apparatus and method for preparing a downhole tool component. The present invention relates particularly to components with conical curved surfaces, such as a slip. A slip is a well-known component of a plug that seals zones in a wellbore. The slip has an outer surface to grip onto the borehole wall when moved radially outward from an original position. This outer surface can be curved to fully engage a generally curved borehole wall. Being fully engaged means that entire surface area of the outer surface contacts the curved borehole wall. There are known coatings for this outer surface to grip borehole walls.

However, the interactions between components within a tool are also important, such as the inner surface of the slip. In most plugs, a cone assembly pushes the slip from the original position toward the borehole wall. The conical surface of the cone assembly engages the slip, and the inner surface of the slip is the corresponding engagement surface for the conical surface of the cone assembly. As the slip moves along the cone assembly, the increasing diameter of the cone assembly pushes the slip radially outward. Thus, the frictional engagement between the conical surface of the cone assembly and the inner surface of the slip must be strong enough to prevent slippage down the conical surface. The conventional solution has been forming a complementary conical curved surface as in the inner surface of the slip, known as a ramp surface. The ramp surface has a shape and a contour to fully engage the conical surface of the cone assembly from original position to extended position with contact on the borehole wall. The entire surface area of the ramp surface contacts the conical surface for the maximum frictional engagement and grip. Similar to the outer surface, there are known coatings for increasing grip on the conical surface.

The coatings pose unique problems for the ramp surface of the slip. The conventional methods, such as sprays, paint, dip and drip, have problems with pooling and thinning on curved surfaces. The ramp surface can also be conical, so the pooling and thinning problems can be even more difficult.

The additional complication is that the tolerances for the cone assembly and slip engagement are very tight. For the surface contacts between components of a downhole tool, slight differences in thickness of a coating can have large effects on skewing a downhole tool within a borehole because of the sheer scale of downhole tools. Even the slight differences of abrasive grain size (diamond powder, sand, etc.) in grit coatings can affect the efficacy of a correctly isolated zone in a wellbore. Uniformity is more important for the inner surface of the slip than the outer surface of the slip. The inner surface has a predictable and regular contact with the cone assembly, so this engagement can be controlled. The outer surface does not require such precision with uniformity, since the coatings on the outer surface will always be engaging different variable surfaces, like the borehole wall or tubulars being passed through the tool. The present invention is an apparatus and method to achieve the uniformity of a grit coating thickness on the ramp surface of a slip that removably engages another component of the downhole tool.

Figure 2:
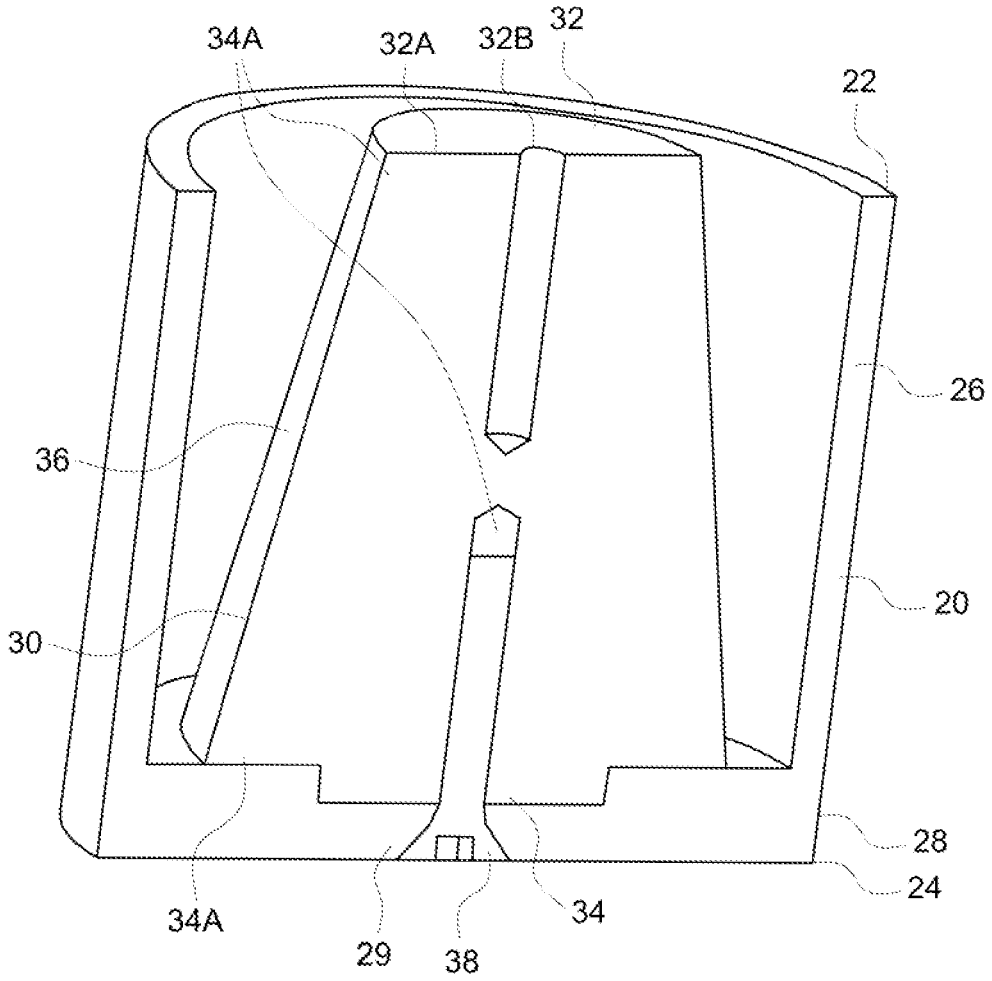
FIG. 2 is a partial perspective and sectional view of embodiments of the casing holder and the cone insert of the apparatus and method of the present invention.
Figure 3:
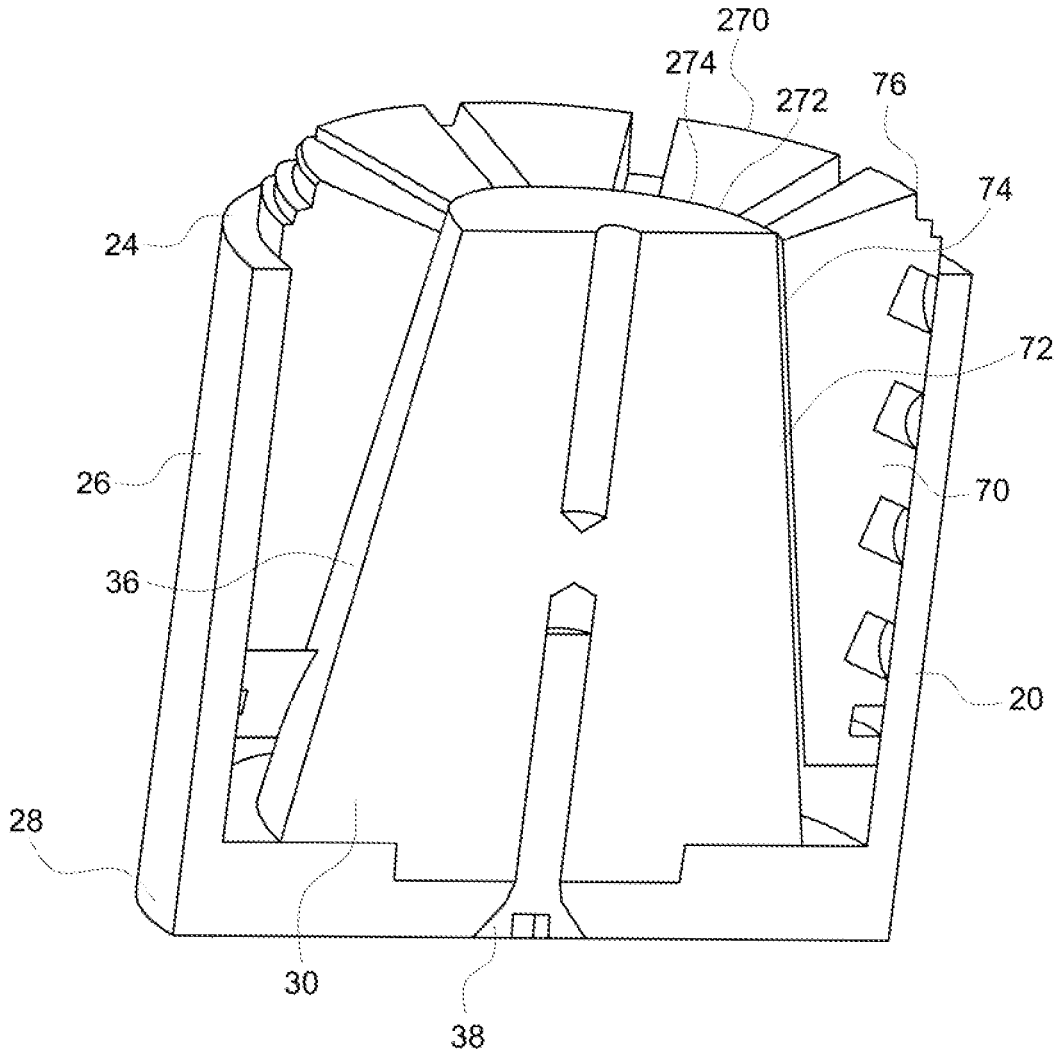
FIG. 3 is a partial perspective and sectional view of embodiments of the slip devices set in the casing holder and cone insert of the apparatus and method of the present invention.
Figure 5:
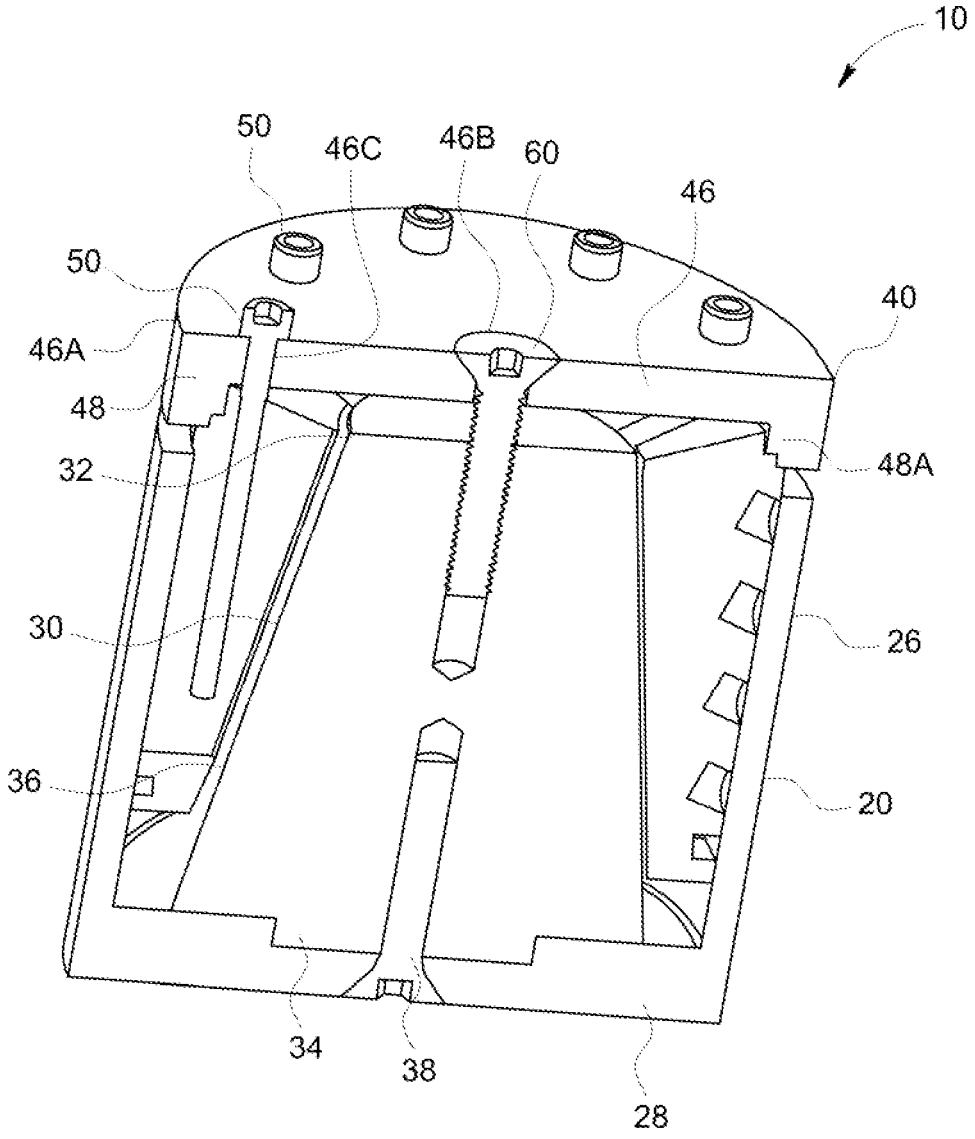
FIG. 5 is a partial perspective and sectional view of embodiment of FIG. 1 for the apparatus and method of the present invention.

FIGS. 1 and 5 show the apparatus 10 for preparing a downhole tool component, namely, a slip 70 with a ramp surface 72. The apparatus 10 includes a casing holder 20, a cone insert 30, and a cap 40. As shown in FIGS. 1, 2 and 5, the casing holder 20 has a top casing end 22 and a bottom casing end 24 and is comprised a cylindrical casing body 26 and an end portion 28 at the bottom casing end. The end portion 28 can be made integral with the cylindrical body 26. The end portion also has a center casing hole 29.

The apparatus 10 includes the cone insert 30 being frustoconical with a top cone end surface 32, a bottom cone end surface 34, and a curved side wall surface 36 between the top cone end surface and the bottom cone end surface, as in FIGS. 1, 2, and 5. The top cone end 32 has a top cone end diameter 32A and a center top cone end cavity 32B. The bottom cone end 34 has a bottom cone end diameter 34A and a center bottom cone end cavity 34B. The top cone end diameter 32A is smaller than the bottom cone end diameter 34A. The cone insert 30 orientation is shown with the smaller end facing upward to define a space for setting the slip 70. A bottom center connector 38 removably engages with the center bottom cone end cavity 34B through the center casing hole 29. The cone insert 30 can be locked within the cylindrical casing body.

Figure 4:
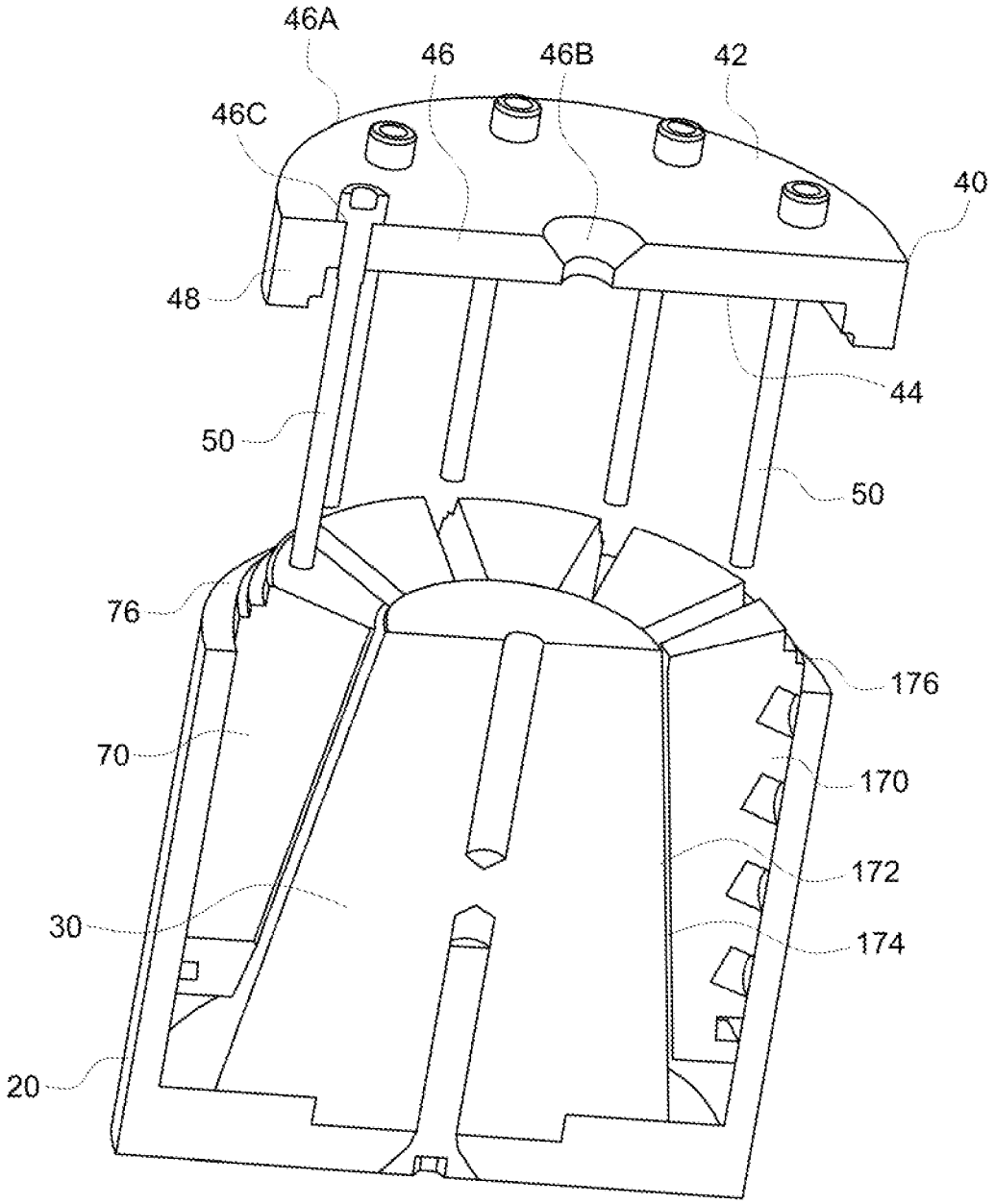
FIG. 4 is a partial perspective and sectional view of embodiments of the cap with spacing bolts, casing holder and cone insert of the apparatus and method of the present invention.

FIGS. 1, 4, and 5 show the cap 40 with a top cap end 42 and a bottom cap end 44. The cap 40 is comprised of a disk 46 with a disk perimeter 46A, a center cap hole 46B, and a plurality of spacing holes 46C around the disk perimeter 46A, and a rim 48 around the disk perimeter 46A. The rim 48 is flush with the disk perimeter 46A with unitary construction. The rim 48 and the disk 46 can be made integral.

The apparatus 10 also includes a plurality of spacing bolts 50 and a top center connector 60 to hold the slip 70 within the space between the cap 40, the cone insert 30, and the casing holder 20. Each spacing bolt 50 is removably inserted through a corresponding spacing hole 46C. Each spacing bolt 50 extends from the cap 40 and into the casing holder 20 toward the casing end portion 28. When more than one slip 70 is loaded into the apparatus 10, the spacing bolts 50 separate and align the slips within the space formed between the cone insert 30 and the casing holder 20. The rim 48 and adjacent spacing bolts 50 hold the position of the corresponding slip mounted into the apparatus. These structures prevent any movement of this slip 70, except for movement allowed by the apparatus 10. The coating 74 applied to the slip 70 can have a uniform thickness set by cone insert 30, casing holder 20, the rim 48, and adjacent spacing bolts 50. The top center connector 60 is removably engaged to the center cap hole 46B and center top cone end cavity 32B.

Embodiments of the present invention include the bottom center connector 38 being in removable threaded engagement with the center bottom cone end cavity 34B. The bottom center connector 38 can be a screw that can be rotated to lock into the cone insert 30 and squeezing the casing holder 20 between the cone insert 20 and the bottom center connector 38. There is no tolerance. The cone insert 30 is locked onto the casing holder 20. The spacing bolts 50 may also be in removable threaded engagement with the respective spacing holes 46C. As bolts or screws with threads, the spacing bolts 50 can be locked in position and extension from the cap 40 toward the space between the cone insert 30 and casing holder 20.

FIGS. 4-5 show embodiments of the spacing holes 46C being radially arranged around the center cap hole 46B. Each spacing hole 46C is between the center cap hole 46B and the disk perimeter 46A. The number of spacing holes 46C determines the capacity for spacing bolts 50 and the capacity for slips 70, 270 to be prepared. Further embodiments of the cap 40 include the rim 48 being comprised of a shoulder ridge 48A so as to engage each slip placed within the casing holder 20. The shoulder ridge 48A is a raised edge compatible with an end of the slip 70. The shoulder ridge 48A holds the slip 70 steady as the apparatus 10 can move the curved side wall surface 36 of the cone insert toward the slip 70.

Embodiments of the present invention also include the top center connector 60 being in removable threaded engagement with the center top cone end activity 32B through the center cap hole 46B. The top center connector 60 can also be a screw that can be rotated. However, there is no locked position. Rotating the top center connector 60 actually sets the uniform thickness of the coating 74. There is tolerance to remove pooling and thinning of the coating 74 from the ramp surface 72 of the slip 70. Actuating the top center connector 60 moves the cap 40 closer to the end portion 28.

In alternative embodiments, the casing holder 20 can be transparent, as well as the cone insert 30. In these embodiments, the coating 74 can be visually inspected for irregularities. The top center connector 60 can be tightened to address the irregularity, or the apparatus 10 can be partially disassembled to remove the slip with the irregularity.

The apparatus 10 is a tool itself to prepare a slip. The slip 70 is not necessarily a component of the apparatus 10. The slip 70 is removeable and replaceable. Entire sets of slips can be prepared with the apparatus 10. However, in some embodiments, the slip 70 can be considered as a removeable component of the apparatus 10. Thus, in these embodiments, the slip 70 has a ramp surface 72. The ramp surface is the complementary conical curved surface as in the inner surface of the slip. The slip 70 is removably inserted between the cone insert 30 and the cylindrical casing body 26 of the casing holder 20 and between adjacent spacing bolts 50 as seen in FIGS. 4-5. The ramp surface 72 faces the cone insert 30. The slip 70 can be comprised of a slip edge 76 on the perimeter of the outer wide end of the slip 70. The slip edge 76 is compatible and is held by the locking shoulder 48A of the cap 40 so that the movement of the slip 70 toward the cone insert 30 is uniform and controlled. The slip edge 76 anchors the slip 70 to the apparatus at the locking shoulder 48A. The coating 74 between the ramp surface 72 and the cone insert 30 can also be recited as a removeable and replaceable component of the apparatus 10 in this alternate embodiment. The coating 74 is a grit coating with abrasive grains bonded to the ramp surface 72. The abrasive grains have size and dimension that requires alignment and shifting to form a uniform thickness.

FIGS. 2-5 further show the present invention as a method for preparing a downhole tool component. The method prepares a component with a complementary conical curved surface, namely a slip. The method comprises the steps of removably engaging a bottom center connector 38 to a casing holder 20 and a cone insert 30 as in FIG. 2. The cone insert 30 is locked in position within the casing holder 20. In some embodiments, the bottom center connector 38 is a screw for removable threaded engagement with the center bottom cone end cavity 34B through the center casing hole 29.

The method includes the step of removably engaging a plurality of spacing bolts 50 to a cap 40. Each spacing bolt 50 is removably inserted through a corresponding spacing hole 46C and is extended from the cap 40 and into the casing holder 20 toward the end portion 28. Each spacing bolt 50 extends from the cone insert 40 toward the cylindrical casing body 26 as in FIG. 4. The method also includes applying a coating 74 to a slip 70 with a ramp surface 72. The coating 74 is bonded to the ramp surface 72. The coating 74 now needs to have uniform thickness to be readied as a useable downhole tool component.

Next, the slip 70 is removably inserted between the cone insert 30 and the cylindrical casing body 26 and between adjacent spacing bolts 50, as shown in FIGS. 1 and 5. The coating 74 and the ramp surface 72 face toward the cone insert 30. The method further includes setting the cap 40 over the slip 70 and the cone insert 30. The slip 70 is in sliding engagement between adjacent spacing bolts 50, and the rim 48 abuts an end of the slip 70. The embodiments can including the locking shoulder 48A engaging a slip edge 76 to control movement and anchor the slip 70 into the apparatus.

When more than one slip 70 is loaded into the apparatus 10, the spacing bolts 50 separate and align the slips within the space formed between the cone insert 30 and the casing holder 20. The rim 48 and adjacent spacing bolts 50 hold the position of the corresponding slip mounted into the apparatus. These structures prevent any movement of this slip 70, except for movement allowed by the apparatus 10. The coating 74 applied to the slip 70 can have a uniform thickness set by cone insert 30, casing holder 20, the rim 48, and adjacent spacing bolts 50.

The method further includes the steps of removably engaging the top center connector 60 to the center cap hole 46B and the center top cone end cavity 32B, and adjusting distance between the cone insert 30 and the slip 70 by the top center connector 60 so as to control thickness of the coating 74 on the ramp surface 72.

In some embodiments of the method, the top center connector 60 is in removable threaded engagement with the center top cone end activity 32B through the center cap hole 46B. The top center connector 60 can also be a screw that can be rotated. The step of adjusting distance includes rotating the top center connector 60 so as to set the uniform thickness of the coating 74. There is tolerance to remove pooling and thinning of the coating 74 from the ramp surface 72 of the slip 70. Actuating the top center connector 60 moves the cap 40 closer to the end portion 28. The slip edge 76 of the slip 70 can be held by the locking shoulder 48A of the cap 40 so that the movement of the slip 70 toward the cone insert 30 is uniform and controlled.

In the alternative embodiment of the casing holder 20 being transparent, the method of the present invention includes detecting an irregularity, such as a blemish, gap, or puddle in the coating 74 through the casing holder 20. These irregularities are caused by initial application of the coating 74 to the conical and curved inner surface of the ramp surface 72. These irregularities are further complicated by the coating 74 being a grit coating comprised of adhesive and abrasive grains. The inherent size and dimensions of each grain requires aligning and shifting grains in order to have a uniform thickness. Once detecting, the step of adjusting distance can be used to remove the irregularity. For example, if the irregularity is pooling of abrasive grains, then the top center connector 60 can be rotated to reduce the distance between the cone insert 30 and the slip 70, which squishes or spreads the pooling of the abrasive grains into a uniform thickness. The cone insert 30 can also be transparent.

In a further alternative embodiment of the method, the slip 70 with the irregularity can be removed and replaced. The method of the present invention includes separating the cap 40 and the spacing bolts 50 from the casing holder 20, and removing the slip 70 from the cone insert 30 and the cylindrical casing body 26. The method includes applying another coating 174 to another slip 170 with another ramp surface 172. Another coating 174 is bonded to another ramp surface 172. Then, the method includes removably inserting another slip 170 between the cone insert 30 and the cylindrical casing body 26. Another coating 174 and another ramp surface 172 face toward the cone insert 30. Another slip 170 with another ramp surface 172 and coating 174 is substituted for the slip 70 with the irregularity that cannot be fixed by squishing or spreading the abrasive grains of the grit coating. The other slips can remain in the apparatus 10. Only the slip 70 with the irregularity is removed so that the entire set of slips can still be set with uniform thickness.

The alternative method further includes replacing the cap 40, when another slip 170 is substituted. The step of replacing the cap 40 is further comprised of the steps of: re-setting the cap 40 over the another slip 170 and the cone insert 30. The another slip 170 is now in sliding engagement between adjacent spacing bolts 150, and the rim 48 abuts the another slip 170 so as to engage the locking shoulder 48A with another end of the another slip 170. The another slip 170 can have a corresponding another slip edge 176. The top center connector 60 removably engages the center cap hole 46B and the center top cone end cavity 32B again. Now, the method includes adjusting distance between the cone insert 30 and the another slip 170 by the top center connector 60 so as to control thickness of the another coating 174 on the another ramp surface 172.

FIG. 5 shows the method for preparing further comprising the steps of: bonding the coating 74 to the ramp surface 72 so as to form a coated slip with a uniform coating on the ramp surface 72. The uniform coating is now set, and the slip 70 must be extricated from the apparatus 10. The method includes separating the cap 40 and the spacing bolts 150 from the casing holder 20, and removing the slip 70 from the cone insert 30 and the cylindrical casing body 26. Finally, the coated slip can be assembled in a downhole tool. The coating 74 is in removably engagement with another component of the downhole tool, such as the cone assembly of the tool. The cone insert 30 is a mimic of the cone assembly of the tool. The coating 74 is between components of the tool, not between the tool and an external surface.

FIG. 5 also shows additional steps before the step of setting the cap 40 over the slip 70 and the cone insert 30. Before the coating 74 is set, an entire set of slips can be prepared with coatings to be set as uniform coatings. The apparatus 10 is compatible with multiple slips at one time. These additional steps are applying coatings to more slips, removably inserting more slips between the cone insert 30 and the cylindrical casing body 26, and adjusting additional distances between the cone insert and the additional slips by the top center connector so as to control additional thicknesses of the additional coatings on the additional ramp surfaces. The additional slips are in sliding engagement between other adjacent spacing bolts, and the rim abuts the additional slips so as to engage the locking shoulder with additional ends of the additional slips.

The present invention provides an apparatus and method for preparing a downhole tool component. In particular, the present invention applies a coating with uniform thickness to a conical and curved surface of a slip for a plug. The geometry of being conical and curved has always presented a challenge for evenly applying coatings. Sprays and dipping have insufficient precision for the tight tolerances of slips and cone assemblies in downhole tools. Simply applying a coating is not sufficient for a reliable slip. Simply applying a coating to a challenging ramp surface is more difficult, and further complicated when the coating is a grit coating. The size and dimension of abrasive grains in a grit coating are even more difficult obstacles to a uniform thickness of the coating. The present invention is not a mold to form a slip. Those molds form the actual slip, and the amount of coating set in mold cannot be seen through the slip. Thus, molds are also unreliable and imprecise. The same pooling and thinning in a mold would be set. There is no way to adjust. Molds fit the slip, including the sides and ends of the slip. Adjusting the mold will adjust the sides and ends and the desired ramp surface of the slip. The apparatus of the present invention only fits the cone insert to the ramp surface. The sides and ends of the slip do not adjust distance to the rim or spacing bolts of the present invention. The shoulder ridge and the slip edge anchor the slip within the device for controlled movement to set the uniform thickness with more precision.

The apparatus and method are a unique tool for finely tuned preparation of components that require great precision. In particular, the method of using the coated slip of the present invention relates to removable engagement with another component, not external surfaces. There is a much higher need for uniformity and precision, since the contact between components will be regular, predictable, and controllable for setting the tool. The variability of the borehole wall or passing tubulars do not require uniformity, since those external surfaces are already variable. The present invention enables precision tools with uniform connections between all slips and the cone for reliable and predictable deployment.

The foregoing disclosure and description of the invention is illustrative and explanatory thereof. Various changes in the details of the illustrated structures, construction and method can be made without departing from the true spirit of the invention.

We claim:

1. An apparatus for a downhole tool component, comprising:

casing holder with a top casing end and a bottom casing end, wherein said casing holder is comprised a cylindrical casing body and an end portion at said bottom casing end made integral with the cylindrical body, said end portion having a center casing hole;

a cone insert being frustoconical with a top cone end surface, a bottom cone end surface, and a curved side wall surface between said top cone end surface and said bottom cone end surface, said top cone end having a top cone end diameter and a center top cone end cavity, said bottom cone end having a bottom cone end diameter and a center bottom cone end cavity, said top cone end diameter being smaller than said bottom cone end diameter;

a bottom center connector removably engaged to said center casing hole and center bottom cone end cavity;

a cap with a top cap end and a bottom cap end, wherein said cap is comprised of:

a disk with a disk perimeter, a center cap hole, and a plurality of spacing holes around said disk perimeter, and a rim being around said disk perimeter and being flush with the disk perimeter;

a plurality of spacing bolts, each spacing bolt being removably inserted through a corresponding spacing hole and extending from said cap and into said casing holder toward said casing end portion; and a top center connector removably engaged to said center cap hole and center top cone end cavity.

2. The apparatus, according to claim 1, wherein said bottom center connector is in removable threaded engagement with said center bottom cone end cavity through said center casing hole.

3. The apparatus, according to claim 1, wherein said spacing holes are radially arranged around said center cap hole, and wherein each spacing hole is between said center cap hole and said disk perimeter.

4. The apparatus, according to claim 1, wherein said rim is comprised of a shoulder ridge so as to engage a slip placed within said casing holder.

5. The apparatus, according to claim 1, wherein said top center connector is in removable threaded engagement with said center top cone end cavity through said center cap hole.

6. The apparatus, according to claim 1, wherein said casing holder is transparent.

7. The apparatus, according to claim 6, wherein said cone insert is transparent.

8. The apparatus, according to claim 1, further comprising:

a slip with a ramp surface, wherein said slip is removably inserted between said cone insert and said cylindrical casing body and between adjacent spacing bolts, said ramp surface facing said cone insert.

9. The apparatus, according to claim 8, wherein said rim is comprised of a shoulder ridge so as to engage said slip, and wherein said slip is comprised of a slip edge removably engaged with said shoulder ridge, further comprising:

a coating between said ramp surface and said cone insert, said coating being bonded to said ramp surface.

10. A method for preparing a downhole tool, comprising the steps of:

removably engaging a bottom center connector to a casing holder and a cone insert, wherein said casing holder has a top casing end and a bottom casing end, and wherein said casing holder is comprised a cylindrical casing body and an end portion at said bottom casing end made integral with the cylindrical body, said end portion having a center casing hole, and wherein said cone insert is frustoconical with a top cone end surface, a bottom cone end surface, and a curved side wall surface between said top cone end surface and said bottom cone end surface, said top cone end having a top cone end diameter and a center top cone end cavity, said bottom cone end having a bottom cone end diameter and a center bottom cone end cavity, said top cone end diameter being smaller than said bottom cone end diameter;

removably engaging a plurality of spacing bolts to a cap, wherein said cap has a top cap end and a bottom cap end, wherein said cap is comprised of:

a disk with a disk perimeter, a center cap hole, and a plurality of spacing holes around said disk perimeter, and a rim being around said disk perimeter, being flush with the disk perimeter, and being comprised of a shoulder ridge, and wherein each spacing bolt is removably inserted through a corresponding spacing hole and is extended from said cap and into said casing holder toward said end portion;

applying a coating to a slip with a ramp surface, said coating being bonded to said ramp surface;

removably inserting said slip between said cone insert and said cylindrical casing body, said coating and said ramp surface facing toward said cone insert;

setting said cap over said slip and said cone insert, said slip being in sliding engagement between adjacent spacing bolts, said rim abutting said slip so as to engage said locking shoulder with an end of said slip;

removably engaging a top center connector to said center cap hole and said center top cone end cavity; and adjusting distance between said cone insert and said slip by said top center connector so as to control thickness of said coating on said ramp surface.

11. The method for preparing, according to claim 10, wherein said bottom center connector is in removable threaded engagement with said center casing hole.

12. The method for preparing, according to claim 10, wherein each spacing bolt extends from said cone insert toward said cylindrical casing body.

13. The method for preparing, according to claim 10, wherein said top center connector is in removable threaded engagement with said center cap hole.

14. The method for preparing, according to claim 10, wherein said casing holder is transparent, the method further comprising the step of:

detecting an irregularity in said coating through said casing holder.

15. The method for preparing, according to claim 14, further comprising the steps of:

separating said cap and said spacing bolts from said casing holder;

removing said slip from said cone insert and said cylindrical casing body so as to remove said irregularity;

applying another coating to another slip with another ramp surface, said another coating being bonded to said another ramp surface;

removably inserting said another slip between said cone insert and said cylindrical casing body, said another coating and said another ramp surface facing toward said cone insert; and replacing said cap over said cone insert.

16. The method for preparing, according to claim 15, wherein the step of replacing said cap over said cone insert is further comprised of the steps of:

re-setting said cap over said another slip and said cone insert, said another slip being in sliding engagement between adjacent spacing bolts, said rim abutting said another slip so as to engage said locking shoulder with another end of said another slip;

removably engaging a top center connector to said center cap hole and said center top cone end cavity; and adjusting distance between said cone insert and said another slip by said top center connector so as to control thickness of said another coating on said another ramp surface.

17. The method for preparing, according to claim 10, further comprising the steps of:

bonding said coating to said ramp surface so as to form a coated slip with a uniform coating on said ramp surface;

separating said cap and said spacing bolts from said casing holder;

removing said slip from said cone insert and said cylindrical casing body; and assembling said coated slip in a downhole tool, wherein said coating is in removably engagement with another component of said downhole tool.

18. The method for preparing, according to claim 10, before the step of setting said cap over said slip and said cone insert, further comprising the steps of:

applying an additional coating to an additional slip with an additional ramp surface; and removably inserting said additional slip between said cone insert and said cylindrical casing body, said additional coating and said additional ramp surface facing toward said cone insert.

19. The method for preparing, according to claim 18, wherein the step of setting said cap over said slip and said cone insert further comprises said additional slip being in sliding engagement between other adjacent spacing bolts, said rim abutting said additional slip so as to engage said locking shoulder with an additional end of said additional slip.

20. The method for preparing, according to claim 18, wherein the step of adjusting distance between said cone insert and said slip by said top center connector further comprises the step of adjusting additional distance between said cone insert and said additional slip by said top center connector so as to control an additional thickness of said additional coating on said additional ramp surface.

* * * * *